US005460084A

United States Patent [19]

Otremba et al.

[11] Patent Number: 5,460,084

[45] Date of Patent: Oct. 24, 1995

[54] METHOD FOR CONTROLLING THE DRIVE OF A HYDRAULIC PRESS

[75] Inventors: Carsten Otremba, Esslingen; Guenther Schaich, Kirchheim-Teck; Joachim Beyer, Ravensburg, all of Germany

[73] Assignee: Maschinenfabrik Mueller-Weingarten AG, Weingarten, Germany

[21] Appl. No.: 208,745

[22] Filed: Mar. 11, 1994

[30] Foreign Application Priority Data

Mar. 16, 1993 [DE] Germany ..... 43 08 344.7

[51] Int. Cl.[6] ..... B30B 15/20; B30B 15/18

[52] U.S. Cl. ..... 100/35; 60/486; 100/48; 100/53; 100/99; 100/269.05; 100/269.14

[58] Field of Search ..... 100/48, 35, 99, 100/53, 269 R; 60/486

[56] References Cited

U.S. PATENT DOCUMENTS

| | | | |
|---|---|---|---|
| 2,300,162 | 10/1942 | Maude | 100/269 R |
| 4,022,096 | 5/1977 | Forichon | 100/48 |
| 4,116,122 | 9/1978 | Linder et al. | 100/269 R |
| 4,155,300 | 5/1979 | Baltschun | 100/269 R |
| 4,235,088 | 11/1980 | Kreiskorte | 100/269 R |
| 4,928,487 | 5/1990 | Nikolaus | 60/486 |
| 5,179,836 | 1/1993 | Dantlgraber | 60/430 |

FOREIGN PATENT DOCUMENTS

| | | | |
|---|---|---|---|
| 0311779 | 4/1989 | European Pat. Off. | 100/48 |
| 2715188 | 10/1978 | Germany . | |
| 2809387 | 1/1980 | Germany . | |
| 3217527 | 11/1983 | Germany . | |
| 3418599 | 11/1985 | Germany . | |
| 3803009 | 9/1988 | Germany . | |
| 4008792 | 9/1991 | Germany . | |
| 62-168696 | 7/1987 | Japan | 100/269 R |
| 634254 | 1/1983 | Switzerland . | |
| 765019 | 9/1980 | U.S.S.R. | 100/269 R |
| 1361019 | 12/1987 | U.S.S.R. | 100/269 R |

OTHER PUBLICATIONS

Steuerungen und Regelungen an Pressen—heute und morgen —, O+P Olhydraulik und pneumatik 34 (1990) Nr. 4, Michael Reinert, pp. 224, 225, 226, 228, 231.

Haas H. et al.: Rotatorische und translatorische Positionierungen mit sekundärgeregelten Motoren bei aufgeprägtem Druck. 8. Aachener Fluidtechnisches Kolloquium Mar. 15–17, 1988, vol. 2, pp. 139–162.

Technische Rundschau, H. 45, 1991, pp. 70–71.

Scheffel Gerd: Antreiben mit geregelten Zylinderantrieben.

(List continued on next page.)

*Primary Examiner*—Stephen F. Gerrity

*Attorney, Agent, or Firm*—Spencer, Frank & Schneider

[57] ABSTRACT

A method for controlling a drive for a hydraulic press employed for at least one of forming and cutting sheets of metal. The method involves a press comprising: a press ram and at least one piston-cylinder unit operatively connected to the press ram and including a drive piston having an upper side and a lower side, the drive piston further comprising an upper cylinder chamber communicating with the upper side, and a lower cylinder chamber communicating with the lower side. The method comprises the step of pressurizing the drive piston with hydraulic medium on at least one of its upper side and its lower side for driving the press ram. The step of pressurizing comprises the steps of: supplying a system pressure network including pressure lines operatively connecting the upper cylinder chamber and the lower cylinder chamber with hydraulic medium at a predetermined maximum operating pressure from a hydraulic accumulator unit thereby equalizing pressures between the upper side and the lower side; and producing a downward movement of the press ram by extracting hydraulic medium from the lower cylinder chamber with a first hydraulic motor having an adjustable swivel angle and thereafter feeding the hydraulic medium to the upper cylinder chamber to pressurize the upper cylinder chamber thereby effecting a controlled volumetric flow of hydraulic medium through the pressure network.

15 Claims, 1 Drawing Sheet

OTHER PUBLICATIONS

In: O+P Ölhydraulik und Pneumatik, 33, 1989, No. 3, p. 197.

Mayr A.: Neuentwickelte Axialkolben–Grossinkelmaschinen. In: O+P Ölhydraulik und Pneumatik, 26, 1982, No. 7, pp. 510–512.

Elektronik 6/25 Mar. 1983, pp. 111 ff.

Mannesmann Rexroth: "Hydrostatische Antriebe mit Sekundärregelung" (Hydrostatic drives having secondary control), vol. 6, Der Hydraulik Trainer, Aug. 1989, pp. 13–18.

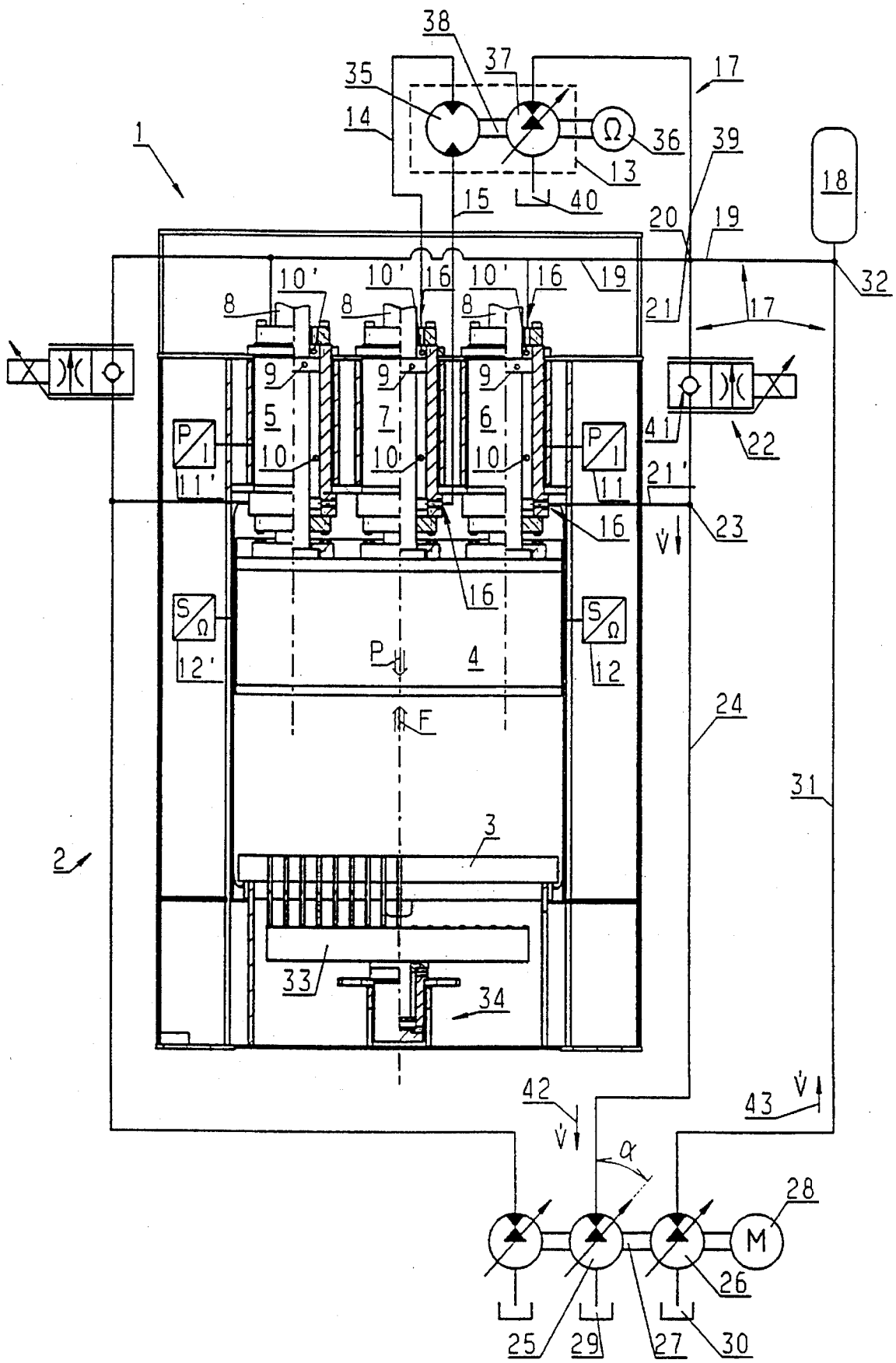
38
37
35
17
14
36
39
1
13
18
15
40
20
19
10'
10'
16
10'
16
19
32
8
8
8
21
17
9
9
9
5
7
6
41
22
P/I
10
10
10
P/I
11'
11
21'
16
23
V̇
16
S/Ω
S/Ω
P
4
12'
12
24
F
31
3
2
33
34
42
43
V̇
V̇
α
28
M
26
25
29
27
30

METHOD FOR CONTROLLING THE DRIVE OF A HYDRAULIC PRESS

FIELD OF THE INVENTION

The invention relates to a method for controlling the drive of a hydraulic press employed for at least one of forming and cutting sheets of metal, and to a device for carrying out the method. The method involves a device including a press ram and at least one piston-cylinder unit operatively connected to the press ram and including a drive piston having an upper side and a lower side, the drive piston further comprising an upper cylinder chamber communicating with the upper side, and a lower cylinder chamber communicating with the lower side. The method includes the step of pressurizing the drive piston with hydraulic medium on at least one of its upper side and its lower side for driving the press ram.

BACKGROUND OF THE INVENTION

The reference "Elektronik 6/25 March 1983, pages 111 ff." has disclosed a "concept for a press optimization system"60 in which different types of press control systems are described. In this case, the press control system is designated as a complex automation system in which a multiplicity of function groups have to be subjected to control. A hydraulic pump is provided in a pressure network in this case for the purpose of controlling a hydraulic press, piston/cylinder units being used to drive the press ram and their pressing and operating pressures being controlled by means of proportional valves. In this case, the downward and upward movement of the press ram is accomplished via pistons which can be pressurized on both sides. A complicated valve control system takes over the flow of the hydraulic medium in the pressure network.

In conventional hydraulic presses, the unloaded press ram is moved downwards and upwards by means of a separate rapid-traverse cylinder. The actual operating cylinders for applying high ram forces are therefore used only during the actual machining operation, for example during the forming or cutting of a workpiece. In this case, the press operates by means of pressure control in the pressure network, that is to say the pressure in the operating cylinders is substantially increased in order to carry out the operation on the workpiece, this being accompanied by an impressed volumetric flow, that is to say an approximately constant volumetric flow.

Conventional systems having an impressed volumetric flow react to load fluctuations on the press ram with a change in the operating pressure. Overall, a pressure increase in the pressure network therefore effects a compression of the oil column, so that given the relatively high compressibility of the oil column it is necessary to feed a volume of oil before a further pressure increase and thus a continuation of movement can take place. This compressibility of the oil column is also termed "hydraulic spring". This leads to negative oscillation responses in the pressure network.

This means that, due to the fact that they have a high hydraulic volume which is to be displaced, hydraulic presses are, rather, slow and affected by relatively large losses, since the hydraulic medium has to be transferred from low pressures to very high pressures. Pressure losses during the expansion of a respective cylinder chamber for the purpose of carrying out a directed movement can be compensated only partially.

A drive concept for hydrostatic drives having a so-called "secondary control" has been disclosed in the reference MANNESMANN REXROTH: "Hydrostatische Antriebe mit Sekundärregelung (Hydrostatic drives having secondary control), volume 6, pages 13–18, Der Hydraulik Trainer, 8/89". In this case, the "secondary control" are systems having "impressed pressure", that is to say the drive of machines is performed according to the principle of hydrostatic drives, in accordance with which a medium is brought to a higher energy level and then can perform work via a suitable structural device. For example, it is possible in a closed circuit for a hydraulic drive to use an electrically driven feed pump for the pressure medium to transfer the latter to a higher pressure level and to drive a hydraulic pump for conversion into mechanical energy. In an open system, a piston/cylinder unit having pistons which can be pressurized on both sides can be driven on both sides in each case by a driven feed pump via a proportional valve control system.

The "secondary control" described in this reference therefore behaves in a manner similar to an electric DC motor, in which the supply voltage is constant and load variations are compensated via a variation in current. Similarly, in the case of a drive having secondary control the system pressure is held constant and the volumetric flow is kept variable in the event of load variation.

The reference provides no information as to how such a secondary control for a press control system of a hydraulic press can be used.

SUMMARY OF THE INVENTION

It is the object of the invention to find a novel method for controlling the drive of a hydraulic press and of an associated press, in which, in particular, use is made of the principle of secondary control.

This object is achieved by the invention after according to which the method comprises the steps of: supplying a system pressure network including pressure lines operatively connecting the upper cylinder chamber and the lower cylinder chamber with hydraulic medium at a predetermined maximum operating pressure from a hydraulic accumulator unit thereby equalizing pressures between the upper side and the lower side; and producing a downward movement of the press ram by extracting hydraulic medium from the lower cylinder chamber with a first hydraulic motor having an adjustable swivel angle and thereafter feeding the hydraulic medium to the upper cylinder chamber to pressurize the upper cylinder chamber thereby effecting a controlled volumetric flow of hydraulic medium through the pressure network.

The basic idea of the invention is that even a press control system permits a systematic application of a so-called "secondary control" of the drive of the press. In this case, the cylinder control system, described in the above reference, by means of proportional valves is abandoned as far as possible in order to provide a new control system. In particular, a hydraulic motor used in the present invention is not intended to convert hydraulic energy into mechanical drive energy, but to effect a novel control of the volumetric flow in the pressure network, in order to achieve a selective control of the drive cylinders.

A technically novel concept for hydraulic presses is proposed, in which the various movements of the press ram and thus of the piston of the piston/cylinder unit driving the press ram are coordinated with one another in such a way that the pressure network operates in a closed circuit, the maximum system pressure being determined by a pressure accumulator. Here, the invention proceeds from the finding that the piston of a piston/cylinder unit is restrained on both sides at as high a pressure level as possible and a force is applied to the press ram due to the fact that the lower cylinder chamber, facing the press ram, of the piston/cylinder unit is relieved by means of a removal of volumetric flow which is selective and controlled by means of a pump or of a hydraulic motor. The control of the hydraulic motor or of the pump is performed via a swivel angle adjustment of the hydraulic motor. The drive energy released in the hydraulic motor during the downward movement of the press ram is transferred via a driving clutch to a feed pump, in particular a controllable one, which likewise applies pressure medium to the upper cylinder chamber of the piston/cylinder unit.

The system according to the invention therefore has the advantage that it makes it possible to dispense with valve control systems using proportional valves to apply pressure to and relieve pressure from the piston/cylinder units, this resulting in a quicker control response. The advantage of the omission of valves is the omission of disturbing switching times and of the pressure peaks in the system which are associated therewith.

A further advantage of the control system according to the invention resides in the elimination of the compressibility of the pressure medium in the pressure network, since because of the constant high pressure level no additional volumetric compressions take place. Consequently, control of the press takes place as a kind of "motor control" instead of a "valve control" as in conventional systems, a hydraulic motor taking over the volumetric flow control.

In an advantageous development of the invention it is, of course, possible to consider different control variants.

In particular, it is possible to use a plurality of operating cylinders and a separate rapid-traverse cylinder, which are respectively connected to the pressure network of the pressure system.

It is, furthermore, advantageous that the largest part of the rapid traverse is accomplished with short-circuited cylinder chambers of the respective drive cylinders. A single valve control system is required in principle for this operation.

Also advantageous is the energy recovery in the hydraulic motor which is assigned to the rapid-traverse cylinder and in which the potential energy produced is converted during at least a portion of the downward movement of the press ram. This energy is used to convey the hydraulic medium in the pressure network. Pressure losses in the system are compensated for by a single motorized drive of the feed pump.

Further advantages of the system reside in the simple way the ram is kept parallel and in the dampening of the cutting shock of the system, for which no further structural and control measures are required.

Further details and advantages of the invention are explained in more detail in the following description of the method and of the device, with the aid of the representation in the figure.

BRIEF DESCRIPTION OF THE DRAWINGS

The sole figure is a diagrammatic representation of a hydraulic press having control numbers for controlling the press in accordance with the invention.

DETAILED DESCRIPTION OF THE INVENTION

The press 1 represented in the figure consists of a press frame 2, which is produced with, for example, a portal design and in which there are mounted a lower press bed 3 for accommodating a lower die (not represented in detail) and a ram 4 for accommodating an upper die (likewise not represented). The upward and downward movement of the press ram 4 is performed in a hydraulic fashion via two pressing cylinders 5, 6, which engage laterally on the press ram and which as operating cylinders serve the purpose of carrying out the forming operation on the workpiece or the like. Instead of two lateral pressing cylinders 5, 6, it is also possible to provide four pressing cylinders arranged in the corner regions of the press ram, it being possible to arrange two further pressing cylinders behind the pressing cylinders 5, 6..

Since the press ram 4 must execute relatively large vertical strokes depending on the size of the dies, use is made of an additional rapid-traverse cylinder 7 as a separate piston/cylinder unit, in order to perform the pure downward movement or the upwards stroke of the press ram.

Both the pressing cylinders 5, 6 and the rapid-traverse cylinder 7 each have a piston rod 8 penetrating the cylinder chamber and an inner piston 9 to which hydraulic medium can be applied on both sides, i.e.: the upper side and the lower side, in the cylinder chamber 10. The cylinder chamber situated below the piston 9, that is, the lower cylinder chamber, is denoted by 10, and the cylinder chamber situated thereabove, that is, the upper cylinder chamber, is denoted by 10'. In the figure, the piston 9 is located in the virtually uppermost position, that is to say the press ram 4 is located approximately at top dead center.

The pressures in the cylinder chamber 10 of the pressing cylinders 5, 6 can be measured by means of pressure measuring units 11, 11'. Likewise, the ram path of the press ram 4 can be measured by a displacement transducer or a speed measuring device 12, 12', it being possible to measure oblique or irregular positions of the press ram.

Provided as a drive for the rapid-traverse cylinder is a drive unit 13, which is still to be explained in more detail and has a first hydraulic line 14 to the upper cylinder chamber 10' and a second hydraulic line 15 to the lower cylinder chamber 10 of the rapid-traverse cylinder 7. Corresponding cylinder chamber feed openings are marked by the reference character 16.

The drive of the pressing cylinders 5, 6 is represented in general in the figure by the example of the pressing cylinder 5, 6. This drive can also be transferred to all other pressing cylinders in the system. The drive of the pressing cylinder 6, which applies to all the pressing cylinders, is described below.

A pressure accumulator 18 which is charged to the maximum system pressure $p_{max}$ is provided in a system pressure network 17 including pressure lines operatively connecting the upper cylinder chamber with the lower cylinder chamber. A first pressure line 19 leads via an associated cylinder chamber feed opening 16 into the upper cylinder chamber 10' of the pressing cylinder 6. Via an intersection 20, a second pressure line 21 leads to a lower cylinder chamber feed opening 16 via a controllable multiway valve 22 and the continuing pressure line 21' and outwards from there to the lower cylinder chamber 10 of the pressing cylinder 6.

Located in the line 21' is a further intersection 23, starting from which the pressure line 24 leads to a controllable pump 25 which is constructed as a controllable hydraulic motor. A further controllable feed pump 26 is seated on the same drive shaft 27 as the pump 25, with the result that the drive of the pump 25 is transmitted to the pump 26. An additional electric motor 28 serves to drive the feed pump 26. The pump 25 is assigned a hydraulic medium accumulator 29, and the pump 26 a further hydraulic medium accumulator 30. A further pressure line 31 leads from the pump 26 to an intersection 32 in the system pressure network.

A master controller (not represented) directs and monitors the machine functions, the individual axes being moved in the closed control loop.

The press bed 3 can have one or more drawing cushions or pressure cheeks 33 with a corresponding drawing cushion control system 34.

The hydraulic press operates as follows:

Phase 1

Phase 1 relates to a stop/start rapid traverse and to a braking operation down to the operating speed as the ram descends. This phase is performed solely by the rapid-traverse cylinder 7 in conjunction with the drive unit 13. In this case, the position and the speed of the traversing movement of the piston 9 in the rapid-traverse cylinder 7 are determined directly by the rotational speed and sense of rotation of a first pump 35 in the drive unit 13. The desired values for this are prescribed by the control electronics with the aid of the displacement measuring systems 12, 12' and of a rotational speed measuring system 36. A controllable hydraulic motor 37 which drives the pump 35 via a common drive shaft 38 serves as actuator. The pump 35 conveys the pressure medium in a closed circuit to the upper cylinder chamber 10' of the rapid-traverse cylinder 7 via the pressure line 14 and to the lower cylinder chamber 10 of the rapid-traverse cylinder 7 via the pressure line 15. The drive of the hydraulic motor 37 is performed via a pressure line 39 of the system pressure network, which branches off at the intersection 20. A hydraulic medium container 40 serves as a pressure medium accumlator for the hydraulic motor 37 in the case of a corresponding sense of rotation.

Together with the pumps 35 and the hydraulic motor 37, the pump system represents the secondary unit, already known in engineering, having a drive principal in accordance with secondary control. However, the hydraulic motor 37 serves to operate a pump system of a rapid-traverse cylinder 7.

The pressing cylinders 5, 6 exert no force in this first phase. This is explained with reference to the pressing cylinder 6 as follows:

During the first phase, the pump 25 is in a stop position with a flow rate equal to 0. This can be achieved by controlling the pump 25.

Via the output of the associated drive motor 28, the downstream pump 26 can charge or hold the accumulator pressure as system pressure and feed it to the accumulator 18 via the line 31. The line 24 is therefore of no importance in the first phase.

The lower cylinder chamber 10 and the upper cylinder chamber 10' of the pressing cylinder 6 are connected via the controllable short circuit valve 22, which is open in the first phase. The pressure level in the pressing cylinder 6 is therefore adjusted to the system pressure in the two cylinder chambers 10', 10' that is to say on the two equal associated piston surfaces, with the result that there is no resultant force on the piston 9.

This control can be used to recover the energy of fall in the rapid-traverse downward movement or the braking movement of the press ram 4 in the lower region, since the pump 35 is driven via the weight of the press ram and drives the hydraulic motor 37 via the drive shaft 38 for the purpose of charging the pressure accumulator 18. Hydraulic medium is removed from the hydraulic medium vessel 40 for this purpose.

Furthermore, the operating cylinder or pressing cylinder 6 can already be prestressed in this phase 1 to the required high and maximum pressing pressure in the system pressure network, for which purpose the energy of fall of the press ram performs work via the drive unit 13. The additional pressure build-up times which are unavoidable in conventional press control systems are thereby avoided.

Phase 2

In the following phase 2, the operating cylinder or pressing cylinder 5, 6 takes over the speed control of the press ram 4. This phase can already be performed during the braking movement at the end of the rapid traverse of the rapid-traverse cylinder 7 or immediately after termination thereof. In this phase, the speed continues to be determined by the rapid-traverse cylinder 7 in the way described above. For this purpose, the ram can have speed measuring systems in conjunction with the displacement measuring systems 12, 12' for the purpose of determining the ram speed.

Phase 2 is described below, again with the aid of the pressing cylinder 6.

The first step in phase 2 is to close the short circuit valve 22 and swivel out the pump 25, that is to say to bring it out of the blocked position into a throughflow position having a controlled throughflow. A special feature here is that owing to the design of the short circuit valves with the function of a non-return valve of the non-return valve 41 this transition between the closure of the short circuit valve 22 and the opening of the pump 25 encounters no control problems at all. In this case, the temporal characteristic of the closure of the short circuit valve 22 and of the swivelling-out of the pump 25 need not be synchronized precisely, and this represents a substantial simplification by comparison with previous solutions. However, the pump 25 should have a slight advance in the temporal opening characteristic before the short circuit valve 22 closes.

During this second transfer phase, a build-up of force in the operating cylinder 6 is still impossible. After termination of this second phase, the speed of the press ram 4 is determined by the volumetric flow V (arrow 42) via the pump 25. The rapid-traverse cylinder 7 is now controlled via the drive unit 13 in such a way that it is entrained by the pressing cylinders 5, 6 during the following operation and itself consumes no more drive energy.

Phase 3

Phase 3 describes the actual operation of the press. In this case, the speed of the press ram 4 is determined by the volumetric flow V of the pump 25 (arrow 42), which is removed from the lower cylinder chamber 10 of the operating cylinder 6. The rotational speed of the pump 25 is determined by the drive motor 28 and held virtually constant. As a result, the volumetric flow from the lower cylinder chamber 10 of the operating cylinder 6 is determined by the pump 25 only by the adjustable swivel angle $\alpha$ of this pump. The corresponding volume of oil is fed via the pressure network 17 on the top side of the cylinder of the piston 9, that is to say in the upper cylinder chamber 10' of the operating cylinder 6, the pressure network 17 being supplied with pressure medium from the accumulator 18 and the pump 26.

As long as no external force yet acts on the ram 4 due to the machining operation, the same operating pressure prevails in the lower 10 and in the upper 10' cylinder chamber. This produces at the pump 25 which in this operation is working as an hydromotor, with a rotational speed given by the motor a torque which is formed by the product of the pressure differences and volumetric flow of the oil. This torque is transferred to the pump 26 via the respectively common drive shaft 27, this torque having the effect that the pump 26 can feed back the same volumetric flow V (arrow 43) into the constant pressure network as was removed from the lower cylinder chamber 10 of the operating cylinder 6 (V 42=V 43). Any system losses can be compensated for via the output of the motor 28.

If, now, an external force F impinges on the press ram 4, for example due to a forming pass of the workpiece, there is a consequent reduction in the speed of the press ram, since the previous force equilibrium is disturbed. This leads immediately to a pressure build-up, that is to say reduction in pressure in the lower cylinder chamber 10, since a volumetric flow V which corresponds to the original desired speed of the press ram continues to be extracted via the pump 25. The rate of the pressure reduction in the lower cylinder chamber 10 of the operating cylinder is determined by the time in which the compression volume can be reduced by the volumetric flow of the pump 25. In this case, the pressure reduction is performed in principle only until the force produced by the pressure difference between the upper cylinder chamber 10' and the lower cylinder chamber 10 of the operating cylinder 6 is equal to the external counterforce. The press ram then once again moves on at the prescribed speed. In this case, the influence on the pump swivel angle $\alpha$ due to the master controller supports the operation to the extent that in the event of a reduction in speed the swivel angle $\alpha$ is increased in order to decrease the pressure reduction time and the entrainment error.

The ram 4 can carry out a non-parallel downward movement due to irregular application of force, and this is detected by the laterally mounted displacement measuring systems 12, 12'. In the case of such a non-parallel movement of the press ram, the respectively leading cylinder can be braked by swivelling in the pump swivel angle and the lagging cylinder can be accelerated by swivelling out the pump swivel angle.

The special feature of this operating phase 3 resides in the fact that, on the one hand, the pressure reduction on the cylinder underside or the lower cylinder chamber 10 is used for the force generation and that, on the other hand, this pressure reduction is realized not by valves but by a pump control system.

The above arrangement results in the following advantages:

The pressure reduction in the lower cylinder chamber of the operating cylinder 6 achieves the implementation of a system pressure network with a high or maximum pressure level and this permits the economic use of accumulators for energy storage. As a result, power peaks can be covered and the installed power can be substantially reduced by comparison with conventional technology, since there is no need to install high pressure differences. The use of a pump control system instead of a valve control system permits recovery of the energy stored in the lower cylinder chambers 10, something which is not possible in the case of conventionally prestressed systems having a valve controlled system. Due to the use of a plurality of operating cylinders 5, 6 or more in this concept, the ram can be held parallel automatically since the pressures in the lower cylinder chambers 10 are respectively reduced only at the site of the action of the external force. The ram can also be held parallel, in particular without separate back-up cylinders or parallel-held cylinders, that is to say without other mechanical components and without loss of ram force.

Finally, the concept described implicitly contains dampening of the cutting shock which, for example, prevents the ram breaking through the workpiece, because the maximum speed of the ram is limited by the pump displacement V from the lower cylinder chamber 10 and is not produced, as in the case of conventional valve control systems, by the existing pressure conditions and the valve characteristics. This dampening of the cutting shock is performed without separate back-up cylinders and without other mechanical components, that is to say without loss of ram force.

Phase 4

A reversal of direction is performed in this phase 4 at the bottom dead center of the press ram. In this position, the speed of the press ram is 0. The maximum pressing force is limited due to the fact that the pressure reduction in the lower cylinder chambers 10 of the respective operating cylinder takes place only up to a prescribed value. The latter is reached by the master control, and, in particular, by appropriate adjustment of the swivel angle $\alpha$ of the pump 25. After the expiration of an adjustable pressure holding time, the respective short circuit valve 22 is opened and the pump 25 is swivelled to 0.

Phase 5

The last phase 5 effects an upwardly directed rapid traverse. For this purpose, this phase is controlled in a manner analagous to phase 1. Any power peaks during acceleration can be removed from the accumulator 18 of the system pressure network 17.

The invention is not restricted to the exemplary embodiment described and represented. Rather, it also comprises all developments and configurations by the person skilled in the art within the scope of the concept of the invention.

1 Press 40 Hydraulic medium vessel
2 Press frame 41 Non-return valve
3 Press bed 42 Volumetric flow V
4 Press ram 43 Volumetric flow V
5 Press cylinder
6 Press cylinder
7 Rapid-traverse cylinder
8 Piston rod
9 Piston
10 Cylinder chamber
11 Pressure measuring units
12 Displacement measuring device
13 Drive unit
14 Hydraulic line
15 Hydraulic line
16 Cylinder chamber feed opening
17 System pressure network
18 Pressure accumulator
19 Pressure line
20 Intersection
21 Pressure line
22 Multiway valve
23 Intersection

24 Pressure line
25 Controllable pump, hydraulic motor
26 Feed pump
27 Drive shaft
28 Electric motor
29 Hydraulic medium accumulator
30 Hydraulic medium accumulator
31 Pressure line
32 Intersection
33 Drawing cushion
34Drawing cushion control system
35 Pump
36 Rotational speed measuring system
37 Pump/hydraulic motor
38 Drive shaft
39 Pressure line

We claim:

1. In a method for controlling a drive for a hydraulic press employed for at least one of forming and cutting sheets of metal, the press comprising:

a press ram; and at least one piston-cylinder unit operatively connected to the press ram and including a drive piston having an upper side and a lower side, the drive piston further comprising an upper cylinder chamber communicating with the upper side, and a lower cylinder chamber communicating with the lower side;

the method comprising the step of pressurizing the drive piston with hydraulic medium on at least one of its upper side and its lower side for driving the press ram, the improvement wherein the step of pressurizing comprises the steps of:

supplying a system pressure network including pressure lines operatively connecting the upper cylinder chamber and the lower cylinder chamber with hydraulic-medium at a predetermined maximum operating pressure from a hydraulic accumulator unit thereby equalizing pressures between the upper side and the lower side; and producing a downward movement of the press ram by extracting hydraulic medium from the lower cylinder chamber with a first hydraulic motor having an adjustable swivel angle and thereafter feeding the hydraulic medium to the upper cylinder chamber to pressurize the upper cylinder chamber thereby effecting a controlled volumetric flow 6 of hydraulic medium through the pressure network.

2. The method according to claim 1, wherein the step of producing includes the step of controlling a downward movement of the press ram by utilizing the first hydraulic motor to control the volumetric flow of hydraulic medium extracted from the lower cylinder chamber, the method further including the step of maintaining a constant pressure in the system pressure network, in the upper cylinder chamber and in the lower cylinder chamber when the press ram is not subjected to a load from a workpiece.

3. The method according to claim 1, wherein the step of producing further includes the step of reducing a pressure in the lower cylinder chamber when the press ram is subjected to a load from a workpiece by extracting hydraulic medium from the lower cylinder chamber with the first hydraulic motor while maintaining the controlled volumetric flow at a constant value thereby creating a pressure in the upper cylinder chamber which is higher than the pressure in the lower cylinder chamber such that the load from the workpiece is opposed by a counterload from the pressure ram.

4. The method according to claim 1, wherein the step of producing further includes the step of transmitting a torque from a drive shaft of a drive shaft of the first hydraulic motor to a drive shaft of an electrically driven feed pump, and wherein the step of feeding includes the step of utilizing the feed pump to feed hydraulic medium to the upper cylinder chamber.

5. The method according to claim 1, wherein the step of producing further includes the step of adjusting the swivel angle of the first hydraulic motor to control the volumetric flow of hydraulic medium through the system pressure network.

6. The method according to claim 1, and further including the step of performing a rapid-traverse of the press ram in one of an upward direction and a downward direction by utilizing a rapid-traverse piston-cylinder unit including a rapid-traverse drive piston having an upper side and a lower side, the step of performing including the steps of:

pressurizing the rapid-traverse piston on at least one of its upper side and its lower side; and effecting a hydraulic short circuit between the upper cylinder chamber and the lower cylinder chamber of the at least one piston cylinder unit by utilizing a multiway valve unit during the step of pressurizing the rapid-traverse piston.

7. The method according to claim 6, and further including the step of closing the multiway valve unit during operation of the first hydraulic motor.

8. The method according to claim 7, wherein the step of performing further includes the step of delaying closure of the multiway valve unit with respect to control of the volumetric flow.

9. The method according to claim 6, wherein the step of performing further includes the steps of:

controlling the hydraulic medium in the rapid-traverse piston cylinder unit during a downward movement of the press ram by utilizing a pump driven by a dead weight of the press ram; and driving a second hydraulic motor with the pump for feeding the system pressure network with hydraulic medium.

10. The method according to claim 9, wherein the step of performing further includes the step of recovering a potential energy of the press ram in the second hydraulic motor during the downward movement of the press ram.

11. The method according to claim 1, wherein the at least one piston-cylinder unit includes one of two piston-cylinder units disposed laterally on the press ram and four piston-cylinder units disposed at corner regions of the press ram, the step of pressurizing further including the step of driving each piston-cylinder unit with a separate drive control system.

12. The method according to claim 1, and further including the step of measuring pressure fluctuations in the system pressure network with a pressure measuring unit disposed in the lower cylinder chamber.

13. The method according to claim 1, and further including the step of measuring at least one of a displacement and a speed of the press ram with a displacement measuring device thereby detecting any irregular positions of the press ram.

14. The method according to claim 1, wherein the at least one piston-cylinder unit includes at least two piston cylinder units, the method further including the step of compensating for an irregular loading of the press ram by respectively pressurizing the at least two piston cylinder units.

15. The method according to claim 1, and further including the step of hydraulically restraining a movement of the drive piston by controlling the first hydraulic motor in order to avoid accidental piercing of a workpiece by an associated die.

* * * * *